US007048151B1

(12) United States Patent
Wertz et al.

(10) Patent No.: US 7,048,151 B1
(45) Date of Patent: May 23, 2006

(54) AEROSOL CAN HOLDING AND OPERATING DEVICE

(76) Inventors: Shawn P. Wertz, P.O. Box 154, Flinton, PA (US) 16640; Robin L. Wertz, P.O. Box 154, Flinton, PA (US) 16640

( * ) Notice: Subject to any disclaimer, the term of this patent is extended or adjusted under 35 U.S.C. 154(b) by 43 days.

(21) Appl. No.: 10/661,125

(22) Filed: Sep. 15, 2003

(51) Int. Cl.
*B67D 5/64* (2006.01)

(52) U.S. Cl. ..... 222/174; 222/402.1

(58) Field of Classification Search ..... 222/173, 222/174, 402.1, 323, 162, 191, 473
See application file for complete search history.

(56) References Cited

U.S. PATENT DOCUMENTS 2,720,422 A * 10/1955 Mercur ..... 222/174
3,017,056 A * 1/1962 Bishop ..... 222/164
3,856,209 A 12/1974 Hickson
3,977,570 A 8/1976 Smrt
4,566,313 A * 1/1986 Monten ..... 73/40.7
4,886,191 A 12/1989 Yoshitomi
4,969,580 A * 11/1990 Mikhail ..... 222/181.3
5,368,202 A * 11/1994 Smrt ..... 222/174
D355,824 S 2/1995 Smrt
5,518,148 A 5/1996 Smrt
5,918,565 A * 7/1999 Casas ..... 116/211
6,033,560 A * 3/2000 Kisner ..... 210/169
6,378,922 B1 * 4/2002 Troudt ..... 294/19.1
6,450,423 B1 9/2002 Gurule

* cited by examiner

*Primary Examiner*—Frederick C. Nicolas

(57) ABSTRACT

A aerosol can holding and operating device includes an elongated pole having a bottom end and a top end. The top end is open and an aperture extends into an interior of the pole. A notch extends into the top end such that a lip is defined that is spaced from the top end. The aperture is positioned nearer the bottom end than the top end. An elongated tether extends through the aperture and outwardly through the top end. An attaching member is attached to the pole for selectively attaching an aerosol can to the pole when the aerosol can is positioned on the lip. The tether is removably coupled to an actuator of the aerosol can for selectively dispensing contents of the aerosol can.

18 Claims, 4 Drawing Sheets

AEROSOL CAN HOLDING AND OPERATING DEVICE

BACKGROUND OF THE INVENTION

1. Field of the Invention

The present invention relates to spray can extension arm devices and more particularly pertains to a new spray can extension arm device for holding an aerosol can and selectively operating such at a distance from the operator of the device.

2. Description of the Prior Art

The use of spray can extension arm devices is known in the prior art. While these devices fulfill their respective, particular objectives and requirements, the need remains for a device that supports an aerosol can in such a manner as to ensure that the aerosol can is stable when it is actuated for dispensing its contents while spacing it a sufficient distance from the user to allow the user to spray elevated areas.

SUMMARY OF THE INVENTION

The present invention meets the needs presented above by including an elongated pole having a lip thereon for supporting the aerosol can thereon. The lip ensures that the aerosol can is stable when actuated by a tether that pulls the aerosol can toward the lip.

Another object of the present invention is to provide a new spray can extension arm device that includes a telescoping pole so that the user may reach selected heights with the pole.

To this end, the present invention generally comprises an elongated pole having a bottom end and a top end. The top end is open and an aperture extends into an interior of the pole. A notch extends into the top end such that a lip is defined that is spaced from the top end. The aperture is positioned nearer the bottom end than the top end. An elongated tether extends through the aperture and outwardly through the top end. An attaching member is attached to the pole for selectively attaching an aerosol can to the pole when the aerosol can is positioned on the lip. The tether is removably coupled to an actuator of the aerosol can for selectively dispensing contents of the aerosol can.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
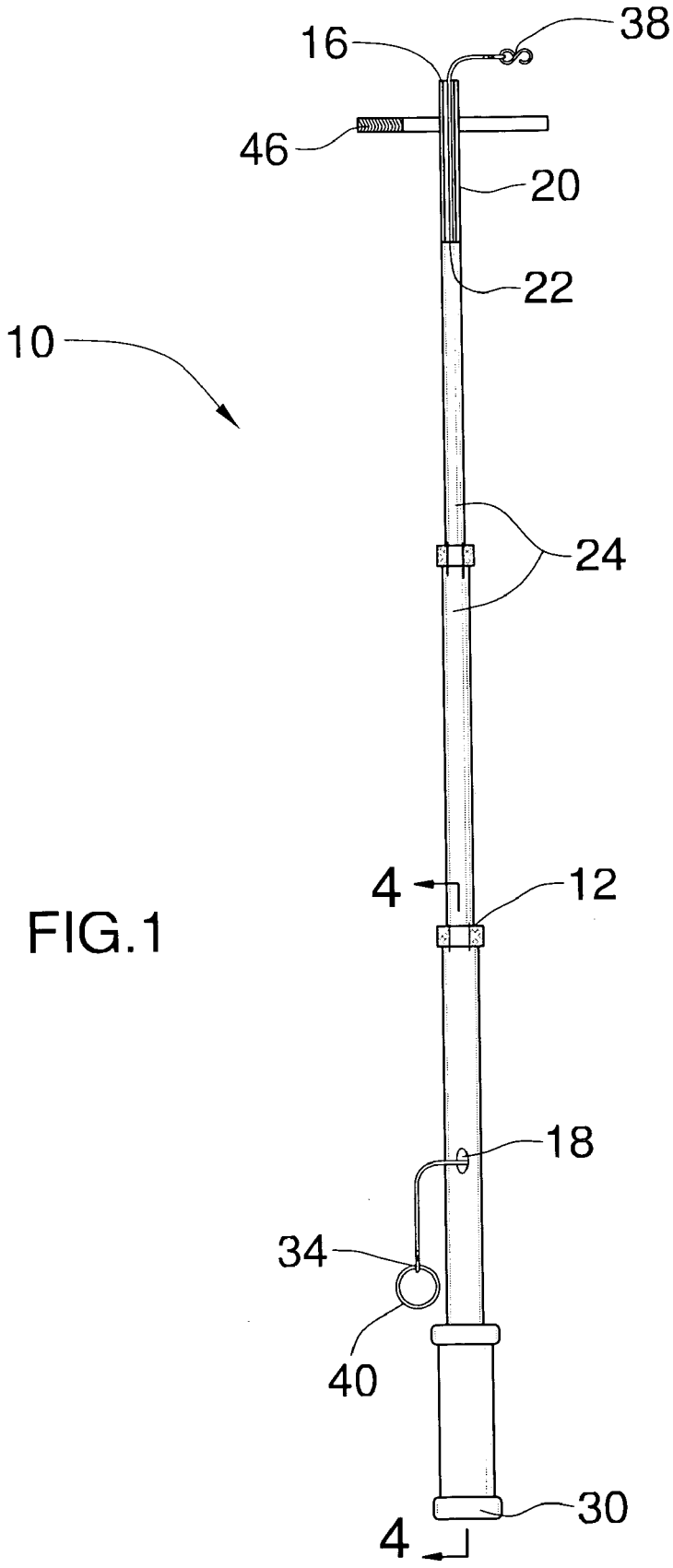
FIG. 1 is a schematic front view of a aerosol can holding and operating device according to the present invention.
Figure 2:
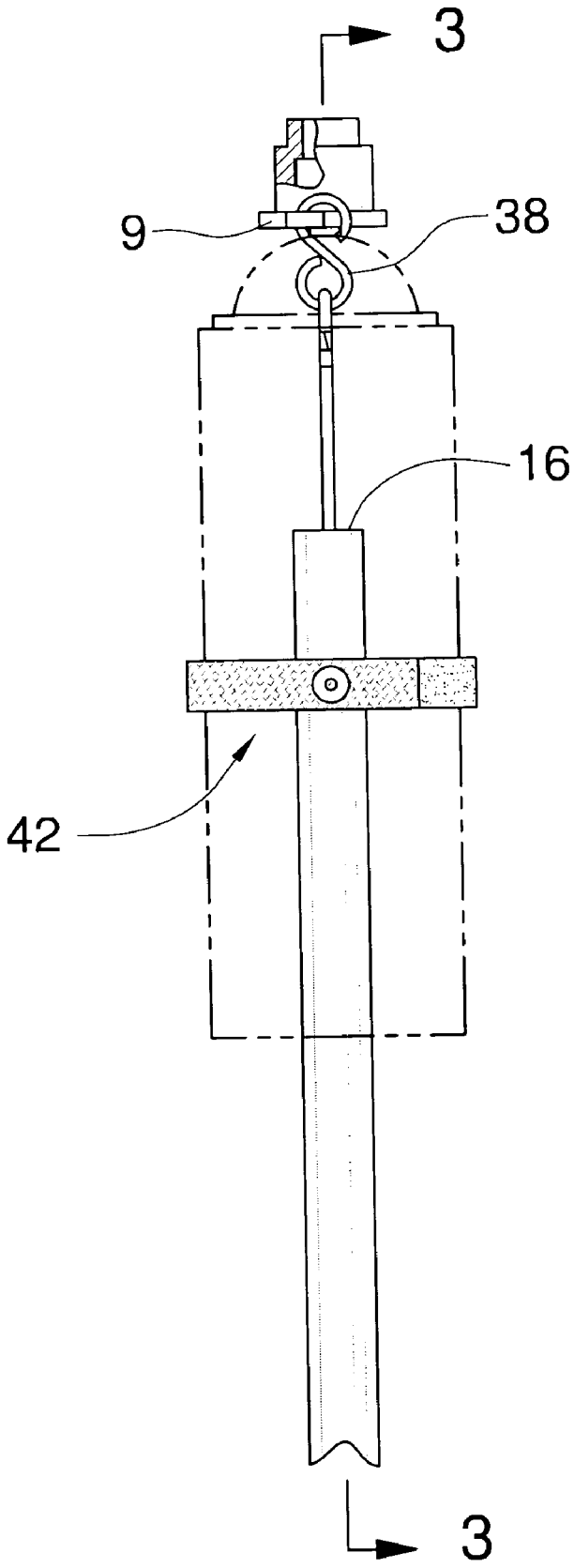
FIG. 2 is a schematic rear view of the present invention.
Figure 3:
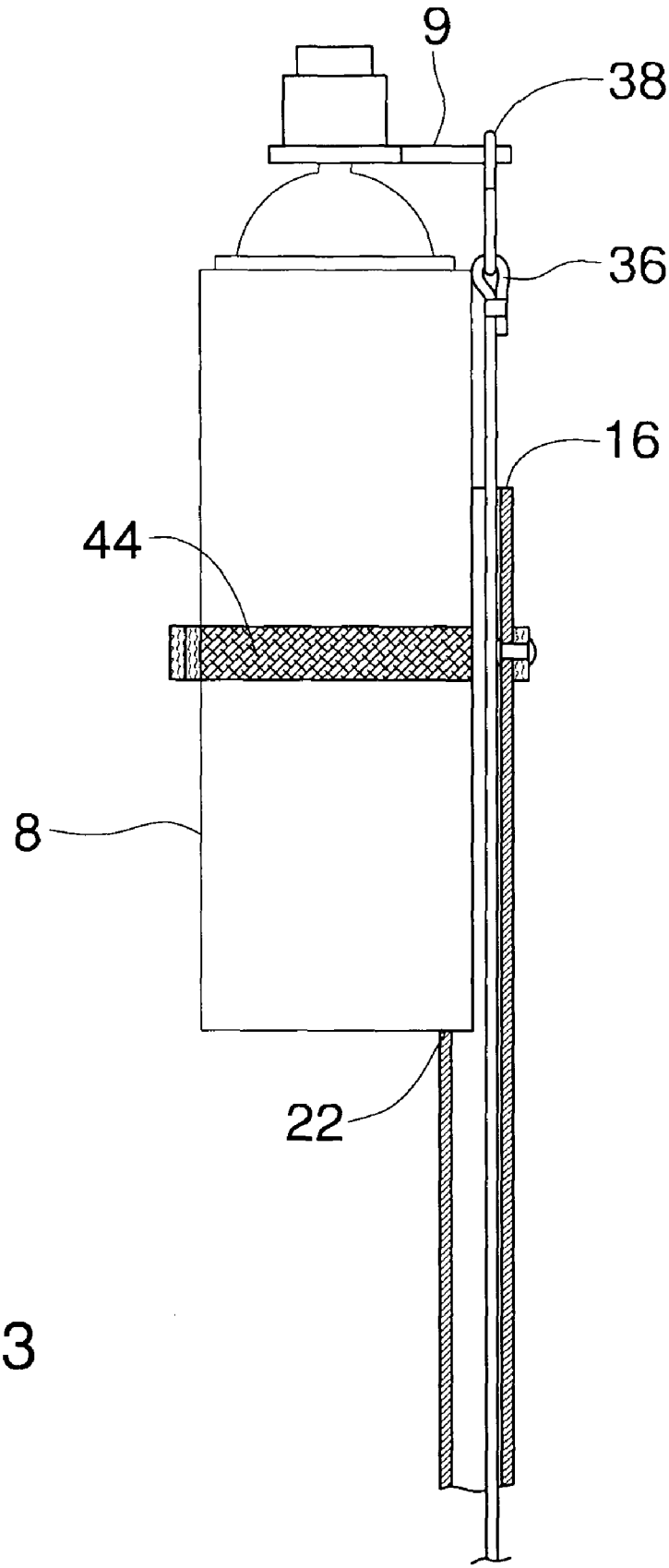
FIG. 3 is a schematic cross-sectional view taken along line 3—3 of FIG. 2 of the present invention.
Figure 4:
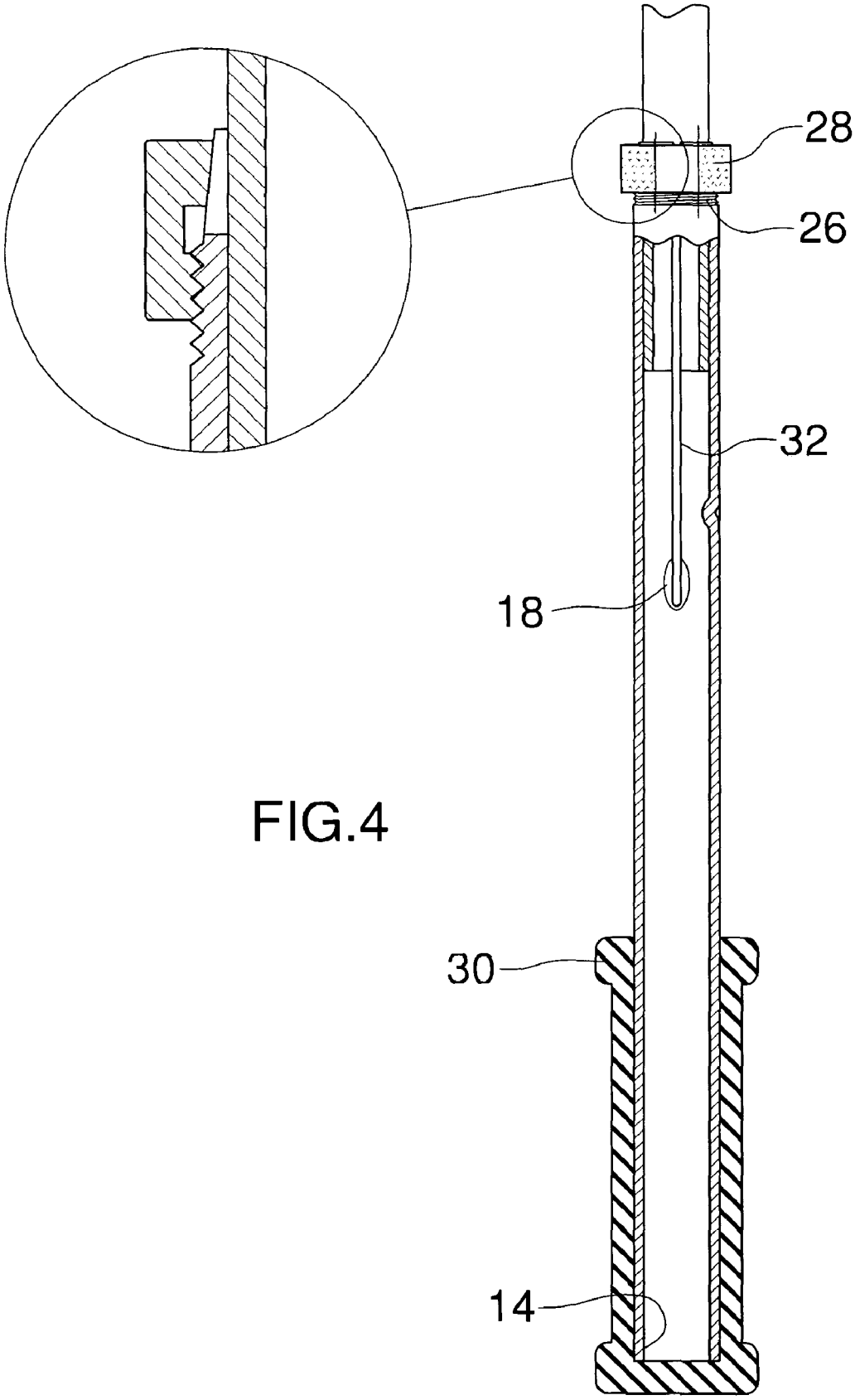
FIG. 4 is a schematic cross-sectional view taken along line 4—4 of FIG. 1 of the present invention.

With reference now to the drawings, and in particular to FIGS. 1 through 4 thereof, a new spray can extension arm device embodying the principles and concepts of the present invention and generally designated by the reference numeral 10 will be described.

As best illustrated in FIGS. 1 through 4, the aerosol can holding and operating device 10 generally comprises an elongated pole 12 having a bottom end 14 and a top end 16. The top end 16 is open and an aperture 18 extends into an interior of the pole 12. The aperture 18 is positioned nearer the bottom end 14 than the top end 16 of the pole 12. A notch 20 extends into the top end 16 such that a lip 22 is defined that is spaced from the top end 16. The lip 22 serves as a ledge for supporting an aerosol can 8 on the pole 12. Preferably, a distance between the lip 22 and the top end 16 is generally between seven and nine inches. Ideally, the pole 12 is selectively telescoping and includes a plurality of sections 24 slidably coupled together. The sections 24 are selectively lockable in an extended position. Corresponding male 26 and female 28 threaded couplers positioned on adjoining sections 24 may accomplish this. It is preferred that a handle 30 is attached to the bottom end of the pole.

An elongated tether 32 extends through the aperture 18 and outwardly through the top end 16. A first end 34 of the tether 32 is positioned adjacent to the aperture 18 and a second end 36 of the tether 32 is positioned adjacent to the top end 14. Ideally, a hook 38 is attached to the second end 36 of the tether 32 and a loop 40 is attached to the first end 34.

An attaching member 42 is attached to the pole 12 for selectively attaching the aerosol can 8 to the pole 12 when the aerosol can 42 is positioned on the lip 22. The attaching member 42 is positioned generally adjacent to the top end 16. The attaching member 42 includes a strap 44 for extending around the aerosol can 8 and is may be attached to the pole 12 with a rivet. A hook and loop fastener 46 is attached to the strap 44 for fastening the strap 44 around the aerosol can 8.

In use, the aerosol can 8, presumably containing a pesticide, is positioned on the lip 22 and attached to the pole 12 with the attaching member 42. The tether 32 is removably coupled to an actuator 9 of the aerosol can 8, and this may be done with the hook 38. The user of the device 10 selectively dispenses contents of the aerosol can 8 by pulling on the first end 34 of the tether 32.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An aerosol can support and actuating device comprising:

an elongated pole having a bottom end and a top end, said top end being open, an aperture extending into an interior of said pole, a notch extending into said top end and forming a lip, said lip being spaced from said top end, said aperture being positioned nearer said bottom end than said top end, the aerosol can being positionable on and extending upwardly from said lip;

an elongated tether extending through said aperture and outwardly through said top end;

an attaching member being attached to said pole for selectively attaching the aerosol can to the pole when the aerosol can is positioned on the lip; and wherein said tether is removably coupled to an actuator of the aerosol can for selectively dispensing contents of the aerosol can.

2. The device of claim 1, wherein a distance between said lip and said top end is generally between seven and nine inches.

3. The device of claim 1, wherein said pole is selectively telescoping and including a plurality of sections slidably coupled together, said sections being selectively lockable in an extended position.

4. The device of claim 1, wherein a first end of said tether being positioned adjacent to said aperture, a second end of said tether being positioned adjacent to said top end, a hook being attached to said second end of said tether for engaging the actuator.

5. The device of claim 1, wherein said attaching member includes a strap for extending around the aerosol can, a hook and loop fastener being attached to said strap for fastening said strap around the aerosol can.

6. The device of claim 3, wherein said attaching member includes a strap for extending around the aerosol can, a hook and loop fastener being attached to said strap for fastening said strap around the aerosol can.

7. The device of claim 6, further including a handle being attached to said bottom end of said pole.

8. The device of claim 1, further including a handle being attached to said bottom end of said pole.

9. An aerosol can support and actuating device comprising:

an elongated pole having a bottom end and a top end, said top end being open, an aperture extending into an interior of said pole, a notch extending into said top end and forming a lip, said lip being spaced from said top end, the aerosol can is positioned on and extends upwardly form said lip, a distance between said lip and said top end being generally between seven and nine inches, said aperture being positioned nearer said bottom end than said top end, said pole being selectively telescoping and including a plurality of sections slidably coupled together, said sections being selectively lockable in an extended position;

an elongated tether extending through said aperture and outwardly through said top end, a first end of said tether being positioned adjacent to said aperture, a second end of said tether being positioned adjacent to said top end, a hook being attached to said second end of said tether;

an attaching member being attached to said pole for selectively attaching the aerosol can to the pole when the aerosol can is positioned on the lip, said attaching member being positioned generally adjacent to said top end, said attaching member including a strap for extending around the aerosol can, a hook and loop fastener being attached to said strap for fastening said strap around the aerosol can;

a handle being attached to said bottom end of said pole; and wherein said tether is removably coupled to an actuator of the aerosol can for selectively dispensing contents of the aerosol can.

10. An aerosol can support and actuating device comprising:

an elongated pole having a bottom end and a top end, said top end being open, an aperture extending into an interior of said pole, a notch extending into said top end and forming a lip that extends into a peripheral side of said pole, said lip being spaced from said top end and defining a ledge, the aerosol can being removably positioned on said ledge, said notch further forming a pair of vertical edges extending upwardly from said ledge, the aerosol can abutting said vertical edges, said aperture being positioned nearer said bottom end than said top end;

an elongated tether extending through said aperture and outwardly through said top end;

an attaching member being attached to said pole for selectively attaching the aerosol can to the pole when the aerosol can is positioned on the lip; and wherein said tether is removably coupled to an actuator of the aerosol can for selectively dispensing contents of the aerosol can.

11. The device of claim 10, wherein a distance between said lip and said top end is generally between seven and nine inches.

12. The device of claim 10, wherein said pole is selectively telescoping and including a plurality of sections slidably coupled together, said sections being selectively lockable in an extended position.

13. The device of claim 10, wherein a first end of said tether being positioned adjacent to said aperture, a second end of said tether being positioned adjacent to said top end, a hook being attached to said second end of said tether for engaging the actuator.

14. The device of claim 10, wherein said attaching member includes a strap for extending around the aerosol can, a hook and loop fastener being attached to said strap for fastening said strap around the aerosol can.

15. The device of claim 13, wherein said attaching member includes a strap for extending around the aerosol can, a hook and loop fastener being attached to said strap for fastening said strap around the aerosol can.

16. The device of claim 15, further including a handle being attached to said bottom end of said pole.

17. The device of claim 10, further including a handle being attached to said bottom end of said pole.

18. The device of claim 10, wherein:

said aperture is positioned nearer said bottom end than said top end, said pole being selectively telescoping and including a plurality of sections slidably coupled together, said sections being selectively lockable in an extended position;

a second end of said tether is positioned adjacent to said top end, a hook being attached to said second end of said tether;

said attaching member is positioned generally adjacent to said top end, said attaching member including a strap for extending around the aerosol can, a hook and loop fastener being attached to said strap for fastening said strap around the aerosol can; and a handle being attached to said bottom end of said pole; and wherein said tether is removably coupled to an actuator of the aerosol can for selectively dispensing contents of the aerosol can.

* * * * *